US005383383A

United States Patent [19]

Garuglieri

[11] Patent Number: 5,383,383

[45] Date of Patent: Jan. 24, 1995

[54] TOOL MOUNTING MEANS AND IMPLEMENT THEREFOR

[75] Inventor: Andrea Garuglieri, Colle Brianza, Italy

[73] Assignee: Black & Decker Inc., Newark, Del.

[21] Appl. No.: 86,479

[22] Filed: Jul. 2, 1993

[30] Foreign Application Priority Data

Jul. 4, 1992 [GB] United Kingdom ..... 9214269

[51] Int. Cl.[6] ..... B26D 1/12

[52] U.S. Cl. ..... 83/666; 83/698.41

[58] Field of Search ..... 83/698.41, 666, 676; 30/388; 31/168

[56] References Cited

U.S. PATENT DOCUMENTS 4,005,622 2/1977 Bassett .

4,507,999 4/1985 Dezern .

FOREIGN PATENT DOCUMENTS 8420700 1/1986 Germany .

*Primary Examiner*—Kenneth E. Peterson

*Attorney, Agent, or Firm*—Dennis A. Dearing; John D. Del Ponti; Charles E. Yocum

[57] ABSTRACT

A saw (10) comprises a housing, a drive spindle (20) rotatably mounted in the housing and a circular saw blade (not shown) adapted to be releasably mounted on one end of the spindle. The blade fits over the threaded end (25) of the spindle and a nut (26) clamps the blade to the spindle. The spindle is in the form of a sleeve and is rotatable about a shaft (22) fixed in the housing. The bore (30) through the end of the spindle is of hexagonal section and corresponds with a bore (32) formed in the end of the shaft.

A wrench (40) is used to remove the blade and has a socket (48) to engage the nut and a freely rotatable pin (50) which also has a hexagonal section and which is adapted to fit in the bores (30,32) when the socket is on the nut and lock the spindle to the shaft.

4 Claims, 3 Drawing Sheets

TOOL MOUNTING MEANS AND IMPLEMENT THEREFOR

BACKGROUND OF THE INVENTION

This invention relates to a means of mounting a tool on a drive spindle and to an implement for mounting and dismounting the tool in a convenient manner. The invention is particularly concerned with the mounting of circular saw blades and other disc like tools on the end of a drive spindle and an implement for mounting and dismounting the tool in a convenient manner.

Circular saw machines typically have a spindle rotated by a motor with the circular saw blade being mounted on a shoulder of the spindle and retained in place by a nut or bolt screwed to a threaded end of the spindle and clamping the saw blade against the shoulder. When no power is applied to the motor, the spindle is usually freely rotatable, and it is nearly always a problem to prevent it from rotating when it is desired to undo the spindle nut to change the blade. Thus it usual for some form of spindle lock to be provided, or to provide an aperture in the saw blade through which an implement can be inserted and locked in a second aperture in the housing of the saw so as to prevent the saw blade from rotating. Such implement may be any convenient tool such as a screw driver or the like and is consequently not normally supplied with the saw machine. It is often inconvenient to locate appropriately sized instruments for removing the blade and it is the object of the present invention to provide a means of mounting and dismounting a tool from a drive spindle which necessitates the use of only one instrument which is specially adapted for that purpose and which can be supplied with the sawing machine.

SUMMARY OF THE INVENTION

Thus in accordance with the present invention there is provided a power tool comprising a housing, a drive spindle rotatably mounted in the housing and a tool adapted to be releasably mounted on a threaded end of said drive spindle, said tool having an aperture whereby a nut or bolt is engageable with said threaded end to clamp the tool to said spindle, characterised in that the spindle is a sleeve and is rotatable about a shaft fixed in the housing, in that at least part of the bore through said threaded end of the spindle is of non-circular section and in that a bore of non-circular section is formed in that end of said shaft which is nearest said threaded end, an implement of corresponding non-circular sections being insertable through said threaded end of the spindle and into said bore of the shaft to lock rotationally said spindle and shaft.

Preferably the bores through said threaded end of the spindle and said shaft are the same, and in which event said implement has a section corresponding with the sections of both bores.

The invention also provides an implement for mounting and dismounting a tool from said power tool comprising a handle having at one end thereof a socket for engagement with said nut or bolt characterised in that the socket has a freely rotatable pin mounted therein, said pin having sections corresponding with said sections in said threaded end of the spindle and said shaft and being arranged such that when said socket is engaged with the nut, the pin is inserted through said bores to lock the spindle and shaft together, the implement being rotatable about said pin so that the socket tightens and loosens said nut.

Preferably said implement is stamped from a single sheet of metal to form an elongate wrench having a substantially U-shaped slot formed at one end, the outside curved portion of said U forming said socket and said pin being rotatably mounted on the end of the tongue formed between the arms of said U, the pin being arranged concentric with said socket and said tongue and socket being stepped in the line of said pin with respect to one another.

Such an implement is easy and inexpensive to manufacture and can easily be supplied with sawing machines provided with blade mounting and dismounting means as hereinbefore defined. The implement can be mounted on the machine at a convenient location so that it is easily to hand (and is all that is required) for changing the blade of the machine as and when necessary.

BRIEF DESCRIPTION OF THE DRAWINGS

The invention is further described hereinafter, by way of example only, with reference to the accompanying drawings, in which.

DETAILED DESCRIPTION OF PREFERRED EMBODIMENTS

Figure 1:
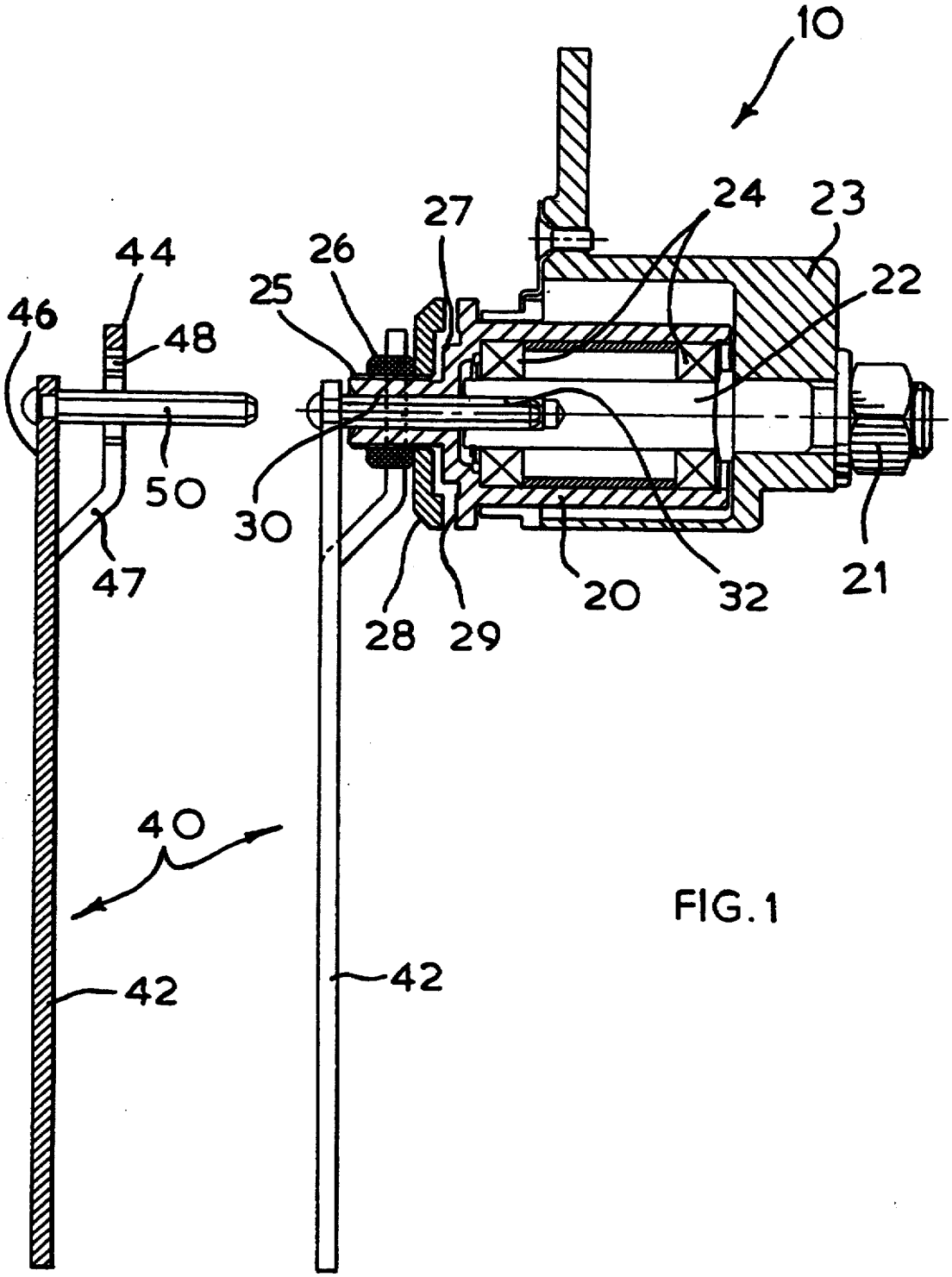
FIG. 1 is a side section through a circular saw spindle and a blade wrench for removing a saw blade on the spindle.

FIG. 1 shows part of a circular saw 10 which comprises a drive spindle 20 rotatably mounted on a fixed axle shaft 22 through bearings 24. Axle 22 is bolted to housing 23 of the saw by nut 21. The drive spindle 20 is in the form of a sleeve whose end 25 is of reduced diameter and is threaded to receive a nut 26. A circular saw blade (not shown) is mountable on the drive spindle 20 about shoulder 27 formed on the drive spindle 20. The blade is adapted to be clamped between a washer 28 and a face 29 of the shoulder 27 of the spindle 20. Tightening of the nut 26 with respect to the threaded end 25 of the spindle 20 clamps a blade seated on the shoulder 27 between the washer 28 and face 29.

In order to prevent the spindle 20 from rotating when torque is applied to the nut 26, the bore 30 of the sleeve 20 at its threaded end 25 is formed with a non-circular cross section, which may conveniently be of hexagonal cross-section. The shaft 22 is formed with a bore 32 which is concentric with the bore 30 and has a corresponding cross section.

Figure 2:
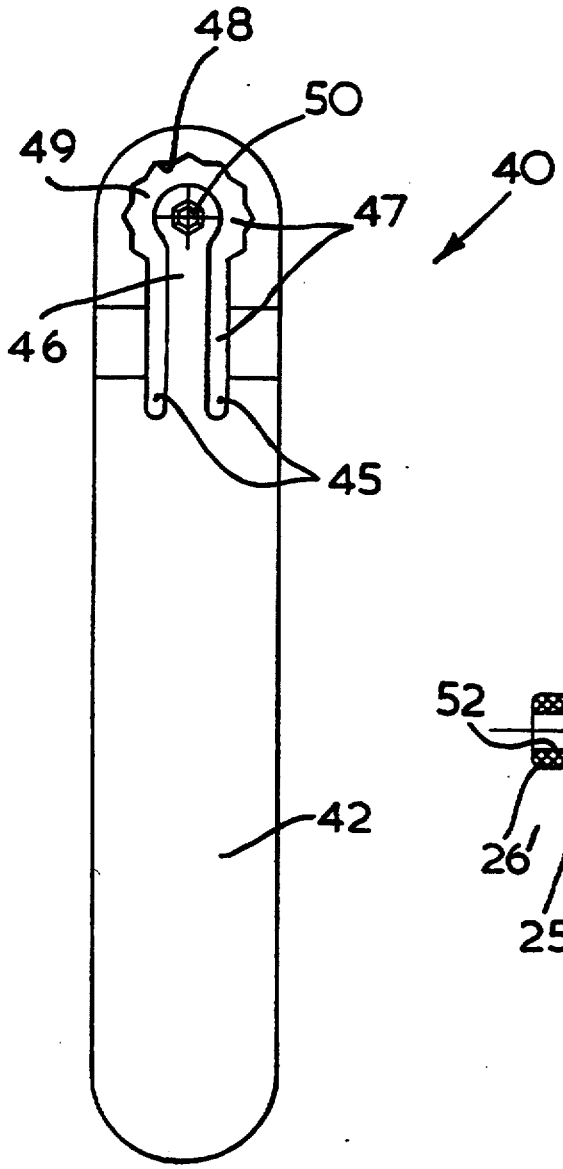
FIG. 2 is a plan review of the blade wrench of FIG. 1.

A suitable implement for mounting and dismounting the saw blade is a wrench 40 which has a socket 48 for co-operation with the nut 26 (see also FIG. 2).

The wrench 40 comprises a handle 42 and a socket end 44 formed by punching out from sheet metal. The socket end 44 has the socket 48, and is formed by punching out a U-shaped slot 47, whose arms 45 define a tongue 46 and whose curved portion 49 defines said socket 48.

The tongue 46 has at its end a pin 50 which is freely rotatable about its axis in the tongue 46.

Moreover, the pin 50 is concentric with respect to the socket 48. The pin 50 has a section corresponding to that of the bores 30, 32 and is arranged such that when the socket 48 engages the nut 26, the pin 50 is simultaneously inserted in the bores 30, 32. By virtue of the non-circular sections of the bores 30, 32 and the pin 50, the latter locks rotationally the spindle 20 and shaft 22 with respect to one another.

The socket portion 48 of the socket end 44 is stepped with respect to the tongue 46 in the line of the pin 50 so that the socket 48 can engage the nut 26, even when fully tightened, without the tongue 46 engaging the free end of the threaded spindle 25. Moreover, the pin 50 is sufficiently long to engage both bores 30, 32, even when the nut is almost fully undone. By the same token, the bore 32 is sufficiently deep to receive the pin 30 even when the nut is fully tightened and without the socket 48 disengaging the nut through the pin hitting the bottom of bore 32.

Thus, in use, the wrench 40 acts as a spindle lock so that the socket 48 can undo the nut 26, while rotating about the pin 50, without the spindle rotating with the nut.

Figure 3:
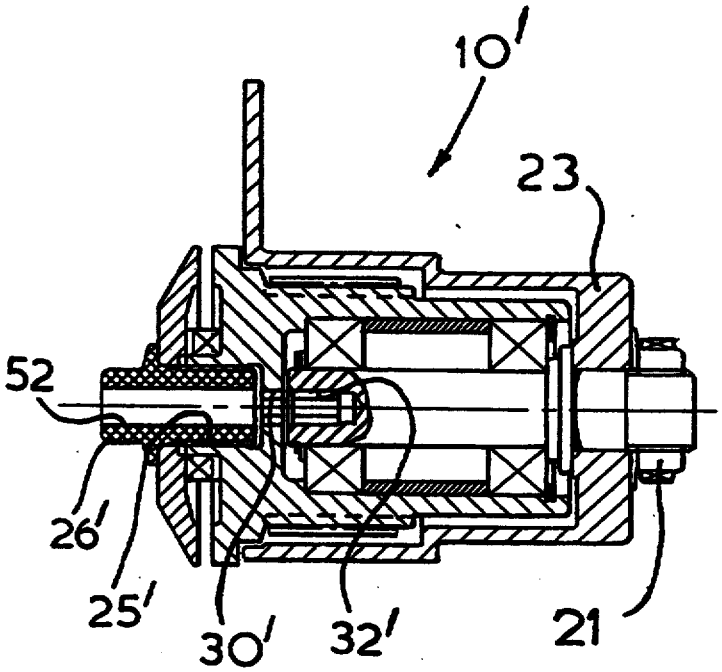
FIG. 3 is an alternative embodiment of the present invention in the stone view as FIG. 1.

With reference to FIG. 3, the spindle 20' is here modified by having an internally threaded end 25' so that a bolt 26' is receivable therein. The bolt 26' has an internal concentric bore 52 through which the implement 40 (or rather its pin 50) must pass before the bores 30', 32' can be engaged. Needless to say, the bore 52 must be sufficiently large to receive the pin 50 in a rotationally free manner.

Figure 4:
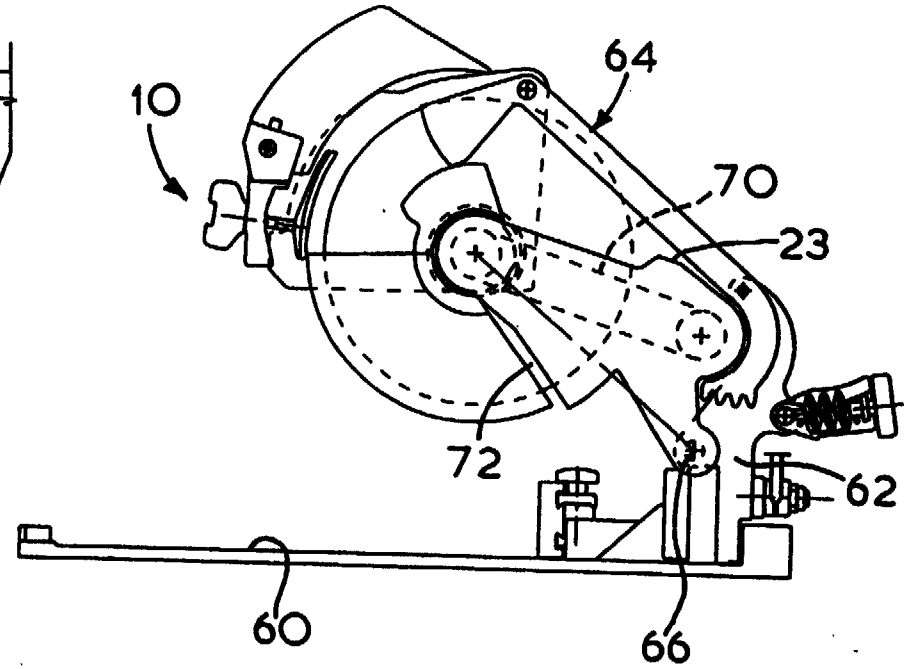
FIG. 4 is a side view of a circular saw.
Figure 5:
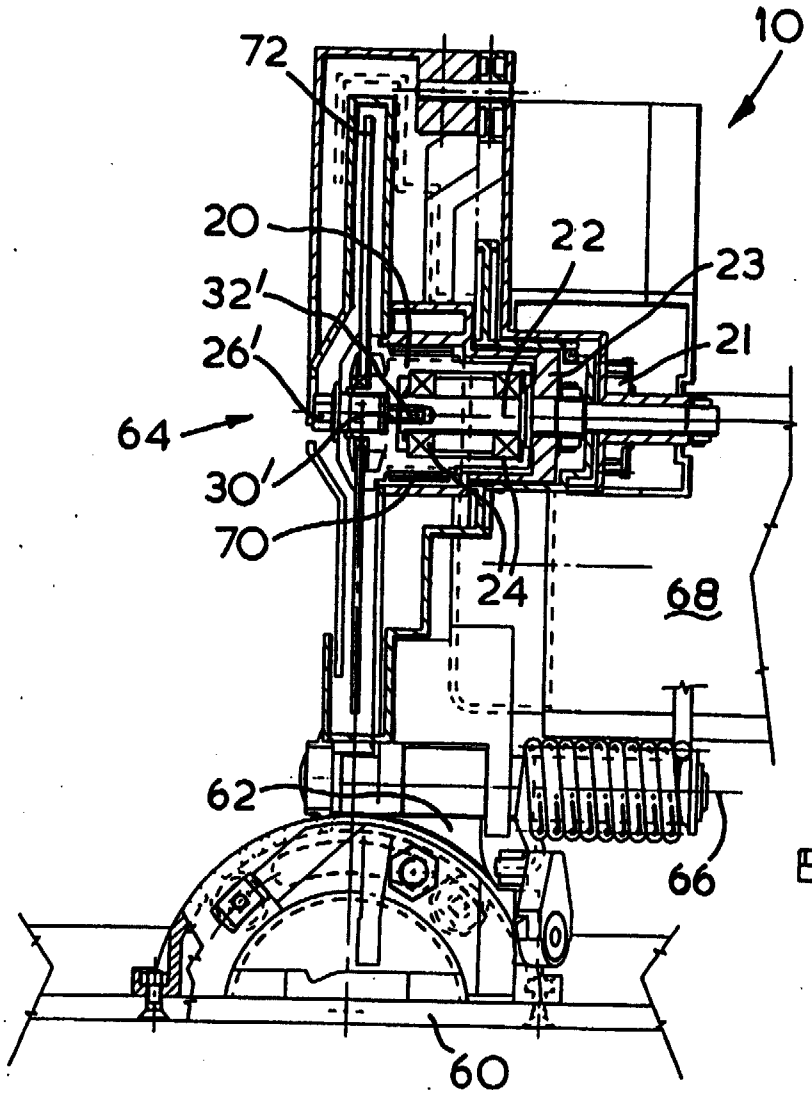
FIG. 5 is a sectional view on the line V—V in FIG. 4.

FIGS. 4 and 5 show a saw machine 10 adapted to employ the arrangements described above with reference to FIGS. 1 to 3, and in particular the embodiment of FIG. 3. The saw has a table 60 on which is supported a pivot member 62. A saw assembly 64 is pivoted to the pivot member about axis 66. Saw assembly 64 has a motor 68 driving through a belt 70 connection the spindle 20 and hence a circular saw blade 72. The saw assembly 64 is adapted to pivot about axis 66 to plunge blade 72 into workpieces supported on the table 60.

It is preferable to employ a bolt 26' as opposed to a nut so that the threads of the spindle will not be damaged when a blade is somewhat carelessly offered up to the spindle and withdrawn from the spindle during blade changing.

I claim:

1. A power tool comprising a housing, a shaft fixed in the housing, a drive spindle in the form of a sleeve journalled for rotation on said shaft, said drive spindle having a threaded end, a tool having an aperture for engagement with said threaded end of the spindle, screw means to engage said threaded end and clamp said tool to said spindle, a first bore of non-circular cross-section in said threaded end of the sleeve, a second concentric bore of non-circular cross-section in the end of said shaft, whereby an implement of corresponding non-circular cross-sections is insertable through said threaded end of the spindle and engaging said bores to lock rotationally said spindle and shaft.

2. A power tool according to claim 1, wherein said first and second bores through said threaded end of the spindle and said shaft have the same cross-section.

3. A power tool according to claim 1, wherein said threaded end is externally threaded and said screw means is a nut.

4. A power tool according to claim 1, wherein said threaded end is internally threaded and said screw means is a bolt which has a bore therethrough of cross-section sufficient to receive said implement in a rotationally free manner.

* * * * *